United States Patent [19]

Sandberg et al.

[11] 4,261,529

[45] Apr. 14, 1981

[54] DEVICE FOR WINDING AND STORAGE OF ROPES AND THE LIKE

[76] Inventors: Robert G. Sandberg, 3933 Oak Dr., Bountiful, Utah 84010; Wade M. Ebeling, 1017 Beecher St., Brigham, Utah 84006

[21] Appl. No.: 111,912

[22] Filed: Jan. 14, 1980

[51] Int. Cl.[3] ..... B65H 75/36; B65H 75/40

[52] U.S. Cl. ..... 242/85.1; 242/96

[58] Field of Search ..... 242/85.1, 86.3 R, 86.5 A, 242/96

[56] References Cited

U.S. PATENT DOCUMENTS

| | | | |
|---|---|---|---|
| 3,174,702 | 3/1965 | French | 242/96 X |
| 3,817,471 | 6/1974 | Finneman | 242/85.1 |
| 3,901,458 | 8/1975 | Kyncz | 242/85.1 |
| 3,926,383 | 12/1975 | McConnell | 242/86.5 A |

FOREIGN PATENT DOCUMENTS

| | | | |
|---|---|---|---|
| 600747 | 7/1934 | Fed. Rep. of Germany | 242/85.1 |

*Primary Examiner*—Edward J. McCarthy

*Attorney, Agent, or Firm*—Terry M. Crellin; B. Deon Criddle

[57] ABSTRACT

A device for winding and storage of ropes, cables, wires, etc., comprises a substantially elongate body portion having a pair of horn-like members extending from opposite ends thereof. The horn-like members are adapted to have a rope or the like coiled therearound, with at least one of the horn-like members being made so that it can be readily turned toward the other horn-like member, whereby the coil of rope or the like is readily disengaged and removed from the device.

4 Claims, 5 Drawing Figures

DEVICE FOR WINDING AND STORAGE OF ROPES AND THE LIKE

BACKGROUND OF THE INVENTION

1. Field:

The present invention pertains to devices used in winding and storage of a rope, cable, wire, or the like, wherein the rope, cable, wire, or the like is intended to be removed from and rewound on the device in repeated cycles.

2. State of the Art:

Various reels have been used in storage of rope, cable, wire and the like. Generally, such reels are not used nor adapted for repeated cycles of unwinding and winding on the reels, with the exception of fishing reels and the like. With reels such as fishing reels, chalk line reels, etc., the line stored on the reel is withdrawn by pulling the line from the rotating reel. Conversely, the line is rewound by rotating the reel in the opposite direction. To my knowledge, there has heretofore been no convenient device proposed which is used in quickly winding a length of rope and the like thereon, wherein the coil of rope wrapped thereon can be quickly and easily disengaged from the device instantaneously rather than by continuous unwinding of the rope from the device.

3. Objectives: A principle objective of this invention is to provide a simple device upon which a length of rope or the like can be wound in a coil, with the resulting coil being readily disengaged for the device instantaneously rather than being unwound therefrom. A particular objective is to provide a windup and storage device useful in recovering and storing pull ropes and cables such as used in water skiing, wherein the rope is to be released substantially instantaneously from the windup device upon subsequent use of the rope in pulling a skier over the water.

SUMMARY OF THE INVENTION

In accordance with the invention, a windup and storage device is provided comprising a substantially elongate body member having a pair of horn-like members extending from opposite ends thereof. The horn-like members are adapted to have a rope or the like quickly wrapped therearound to form a coil of rope along the body member between the horn-like members. The horn-like members are further adapted to securely hold the coil of rope in place on the device until the rope is to be removed for further use. The body member is provided with a hand grip for manually gripping the device as rope or the like is wound thereon.

The device is advantageously used in retrieving a ski rope from the water when the skier has given loose of the end of the ski rope. A person in the boat simply grasps the device in one hand and quickly wraps the rope around the horn-like members as the rope is pulled from the water.

At least one of the horn-like members on the device is made so that it can be readily turned toward the other horn-like member, whereby the entire coil of rope is readily disengaged substantially instantaneously from the device. The release feature is advantageously used in water skiing. After the end of the ski rope is given to the skier and the boat begins to move away from the skier, the coil of rope on the windup device is released therefrom and dropped in the water to uncoil as the boat moves farther from the skier. When the rope has completely uncoiled, the skier is pulled up on the water by the taut rope.

Additional objects and features of the invention will become apparent from the following detailed description of a preferred embodiment, taken together with the accompanying drawing.

THE DRAWING

A preferred embodiment of the device of the present invention representing the best mode presently contemplated of carrying out the invention is illustrated in the accompanying drawings, in which.

DETAILED DESCRIPTION OF THE ILLUSTRATED EMBODIMENT

Figure 1:
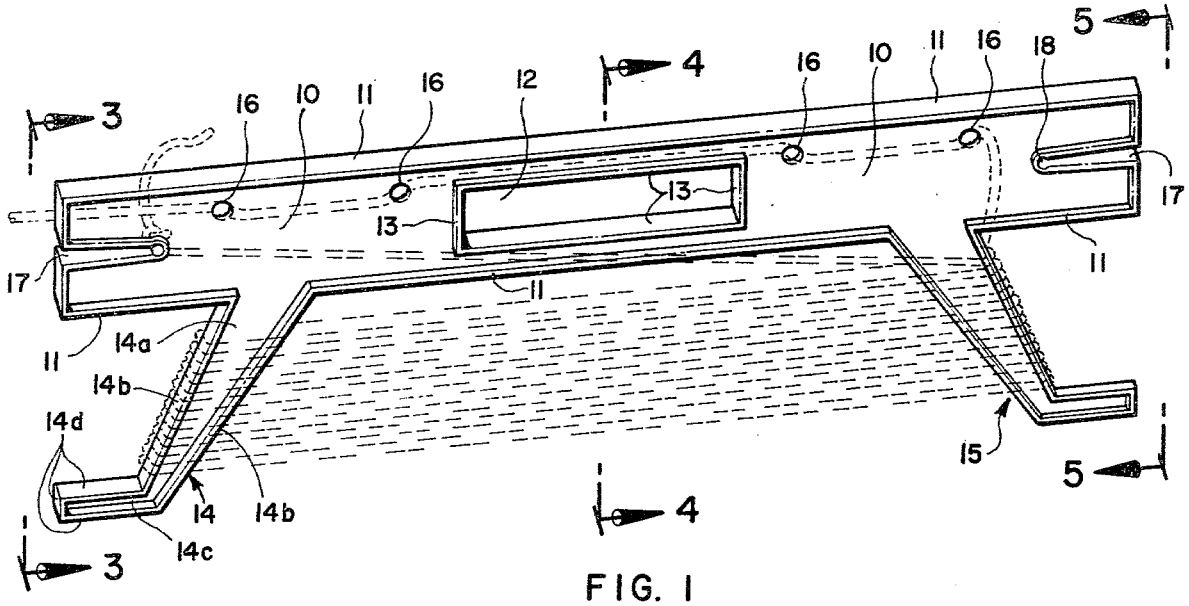
FIG. 1 is a pictorial view of a windup device in accordance with the present invention, showing a rope in dashed lines coiled thereon.

As illustrated, the windup device is integrally molded from a moldable plastic material such as polyethylene, polyropylene, nylon, etc. The device has a substantially elongate body portion 10. The body portion is flat and has an outer flange 11 around its perimeter which adds dimensional strength and stability to the body 10. A rectangular opening 12 (FIG. 1) is provided midway along the length of the body member 10. Either lateral edge of the opening 12 forms a hand grip by which the device is conveniently and securely held in one's hand. A flange 13 is formed around the opening 12 providing a convenient, easily grasped handle and further adding strength and dimensional stability to the body member 10.

A horn-like member 14 extends from one end of the body member 10. The horn-like member 14 comprises an L-shaped element spaced inwardly slightly from the end of the body member 10. The leg **14*a* of the L-shaped element extends downwardly and slants slightly toward the end of the body member 10. The leg 14*a* comprises an extension of the flat portion of the body member 10, and flanges 14*b* are provided on the edges of the leg 14*a* to supply strength and dimensional stability thereto. The foot portion 14*c* of the L-shaped, horn-like, member 14 extends parallel to the body member 10 and points outwardly away from the device. The foot portion 14*c* comprises an extension of the flat portion of the leg 14*a*, with flanges 14*d* provided on the edges and end thereof. As shown, the end portion of the body member 10 and the horn-like member 14** form a generally U-shaped end opening outwardly away from the device.

A second horn-like member 15 extends from the other end of the body member 10. The second horn-like member 15 is generally shaped the same as the first horn-like member 14 and is positioned so that the two horn-like members 14 and 15 are symmetrical with respect to the center cross axis of the body member 10. Thus, the mutually respective foot ends of the L-shaped members 14 and 15 point in mutually opposite directions substantially parallel with the longitudinal axis of the body member 10. A generally U-shaped end opening is formed at the end of the device by the body member 10 and the L-shaped member 15. The U-shaped end formed by L-shaped member 15 opens in the opposite direction to the corresponding U-shaped member at the other end of the device. As shown, a rope or the like can be readily wound upon the L-shaped members 14 and 15 forming a coil which is held in place by the U-shaped openings at the ends of the device.

Figure 2:
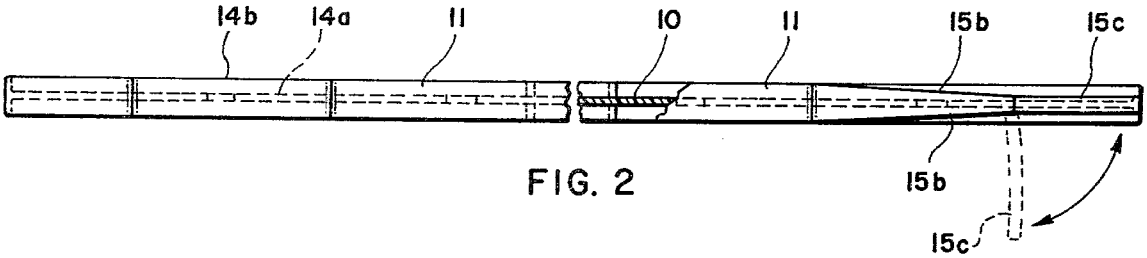
FIG. 2 is a bottom view of the device of FIG. 1 showing in dashed lines the free end of one of the horn-like members turned or bent toward the other horn-like member.
Figure 3:
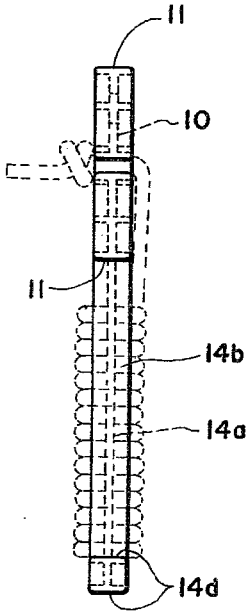
FIG. 3 is an end elevation taken on line 3—3 of FIG. 1.
Figure 4:
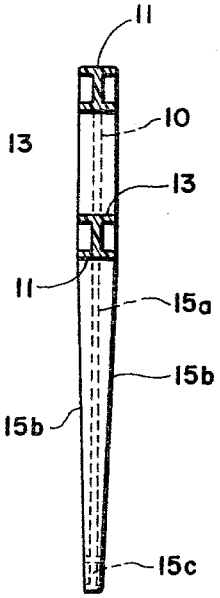
FIG. 4 is a vertical cross section taken on line 4—4 of FIG. 1.
Figure 5:
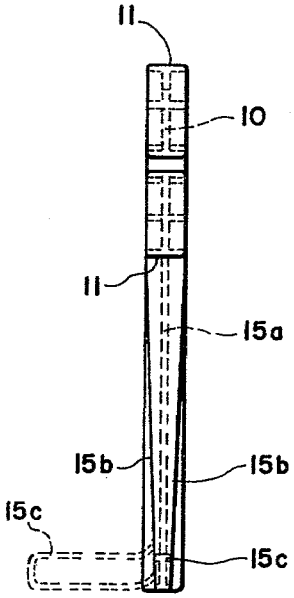
FIG. 5 is the opposite end view taken on line 5—5 of FIG. 1.

At least one of the horn-like members 14 and 15 are made so that the free end thereof is adapted to be turned or bent back towards the center cross axis of the body member 10. As shown in FIGS. 2, 4, and 5, the flanges 15*b* on the edges of the leg 15*a* are tapered from their attachment to the body member 10 in a direction toward the foot portion 15*c*. The end portion of the leg 15*a* is, thus, adapted for partial rotation at its end which is attached to the foot portion 15*c*. The foot portion is readily rotated about the leg 15*a* from its position extending substantially parallel to the longitudinal axis of the body member 10 to a position shown by dotted lines in FIGS. 2 and 5. When the foot member 15*c* is rotated to its position bend outwardly from the body member 10 and toward the other horn-like member 14, a coil of rope or the like wrapped around the horn-like members 14 and 15 is readily disengaged therefrom, with the coil being released altogether and simultaneously rather than being unwound.

Two or more openings can advantageously be provided through the body member 10 at spaced apart positions therealong, whereby one end portion of the rope or the like can be threaded through the openings so that the device is carried by the rope or the like as the rope or the like is used in its extended, uncoiled condition. As shown in FIG. 1, four openings 16 are provided in the body member 10, and one end of the rope, shown by dashed lines, is threaded through the openings 16. When used as a water ski tow rope, the end of the rope which is threaded through the openings 16 is attached to the boat, and the windup device is positioned about four feet from the end of the rope attached to the boat. When the rope is extended in taut condition to a water skier behind the boat, the windup device is carried by the rope so as to be readily available for winding the rope thereon when it is desired to retrieve the rope from the water.

One or more notches can advantageously be provided in the end or ends of the body member 10. As illustrated, a pair of notches 17 are provided in the mutually respective ends of the body member 10. The notches 17 are tapered inwardly, and round openings 18 about the size of the rope which is to be wound on the device can be provided at the inner end of the notches 17. The open space between the notches 17 and the round openings at the ends thereof preferably is somewhat smaller than the diameter of the round openings 18. The notches 17 are useful when the rope coiled on the windup device is to be stored. The loose ends of the rope are readily wedged into the notches 17 and received into the round openings 18 at the inner ends of the notches 17. If the rope is too large to be received in the round openings 18, it can still generally be wedged into and held in the notches 17. Thus, the windup device can be used to store rope of various sizes. When the rope is to be used, the ends are simply pulled from the notches 17, and the rope is removed from the windup device as explained hereinbefore.

Although a preferred embodiment of the invention, which is presently contemplated as the best mode of carrying out the invention, has been illustrated and described, it is to be understood that the present disclosure is made by way of example and that various modifications and variations are possible without departing from the subject matter coming within the scope of the following claims, which subject matter I regard as my invention.

I claim:

1. A device for winding and storage of ropes, cables, wires and the like, said device comprising a substantially elongated body portion; means for manually gripping the body portion; a pair of horn-like members extending from opposite ends of said body, each of said horn-like members including a leg which extends outwardly from said body and a foot which extends from the outer end of said leg substantially parallel to said body and points substantially outwardly away from the device so that the horn-like members are adapted to have a rope or the like coiled therearound, with at least one of the legs of said horn-like members being tapered from its end which is connected to the body portion so that the outer end of the leg and the foot attached thereto can be rotated about the axis of said leg whereby the coil of rope or the like wrapped on the horn-like members is readily disengaged therefrom.

2. A device in accordance with claim 1, wherein the body portion and the pair of horn-like members are molded as a single unit.

3. A device in accordance with claim 1, wherein at least two openings are provided through the body portion and spaced apart therealong, whereby one end portion of the rope or the like can be threaded through the openings so that the device is carried by the rope or the like during use of the rope or the like in its extended, uncoiled condition.

4. A device in accordance with claim 1, wherein at least one notch is formed in the body portion, said notch being adapted to receive the rope or the like in wedging engagement therewith.

* * * * *